US006425799B1

(12) United States Patent
Pai

(10) Patent No.: US 6,425,799 B1
(45) Date of Patent: Jul. 30, 2002

(54) UNDERWIRE BRA

(76) Inventor: Chin-Lung Pai, 1F, No. 8, How Gaang Street, Shyh Lin Chiu, Taipei City (TW)

( * ) Notice: Subject to any disclaimer, the term of this patent is extended or adjusted under 35 U.S.C. 154(b) by 10 days.

(21) Appl. No.: 09/666,792

(22) Filed: Sep. 21, 2000

(51) Int. Cl.[7] ..... A41C 3/00
(52) U.S. Cl. ..... 450/41; 450/66
(58) Field of Search ..... 450/41, 43, 45, 450/47, 49, 51, 52, 65, 66, 72, 73

(56) References Cited

U.S. PATENT DOCUMENTS 1,984,326 A * 12/1934 Titore ..... 450/65
1,989,303 A * 1/1935 Alberts ..... 450/72
2,605,468 A * 8/1952 Kramer ..... 450/41
3,896,818 A * 7/1975 Locascio ..... 450/41
4,275,740 A * 6/1981 Weston ..... 450/41
6,306,005 B1 * 10/2001 Archer ..... 450/47

* cited by examiner

*Primary Examiner*—Gloria M. Hale
(74) *Attorney, Agent, or Firm*—Rabin & Berdo, P.C.

(57) ABSTRACT

A underwire bra mainly comprises an underwire bra cup, in connection with the properly cut elastic cloth as the lining sewed onto the back side of the bra, and further an obverse elastic cloth with the same contour and configuration fully covers the lining and the bra cup, and forms a whole piece bra with a back piece extended from the lining and the bra cup by coupling the sewing seam at the upper edge such that it completely adopts a woman's bust and provides an underwire bra with seamless look, but it still retains the reliability of lifting and supporting a woman's breast. Such structure simplifies the manufacture, lowers the cost, and enhances the production efficiency.

5 Claims, 7 Drawing Sheets

UNDERWIRE BRA

BACKGROUND OF THE INVENTION

1. Field of the Invention

The present invention relates to an improved underwire bra, more particularly to a bra having two bra cups directly deposed on the lining, and the elastic cloth having the same contour and configuration as the bra covers the lining and the bra cups, and a whole-piece single-edge sewing is performed at the edge of the top section of the bra. Such bra structure is a whole-piece with which the wire is not exposed. In addition to its naturally showing the beauty of brassiere, it also can save the manufacturing cost and increase the production rate and the comfort of wearing, and particularly it features an economic way of production and has the effect of perfect fit without binding.

2. Description of the Prior Art

The female brassiere is an important item that decorates the shape of a woman's bust; and it does not only allow the growing breasts to develop properly by completely holding the breasts, but it also can avoid the external expansion and of the breast, and provide a bra for adults to show the erecting breast and the ditch of the bust. Therefore it is a daily necessity for women for years. Due to the influence of fashions, transparent, low-cut, and curve exposed brassiere generally embarrasses the users. The latest model of the brassiere has a big change in its design, and that is to hide the wire to provide an unaccentuated look and allow the user to go with the fashion. However, the conventional underwire bras have a structure as shown in FIGS. 1 and 2 and they generally have wire 11 along the periphery of the bra cup 12, and a piece of cloth 13 in the front being formed into a lining 1, and such lining 2 having a shoulder strap 21 and a piece of cloth 22 at the back to go with the obverse cloth 2 that are sewed along their periphery S. Such structure accomplishes a bra model that hides the wire 11 of the bra. Please refer to FIG. 2 for its detailed structure and shape. Since the manufacture of such bra uses the method of sewing S the whole periphery, therefore its manufacturing is more complicate, which does not only affect the production efficiency and production value, but it also increases the cost for the complicate sewing. Therefore, products of this sort usually are expensive, and not economic for the daily usage. In addition, the formation of the whole-piece bra has seams for the coupling of the back piece 22, and it does not offer a perfect fit for the curve, and it loses the beauty. Such uneven seams also generate an uncomfortable feeling when contacted with the user's skin. Therefore, it is necessary to improve the conventional bras.

In view of the shortcomings and inconvenience of the prior art mentioned above, which are the subjects of improvements for a long time, hence the inventor of the present invention based on years of experience accumulated from the engagement in the related industry conducted extensive research to resolve the foregoing shortcomings and invented the present invention.

Therefore, the primary objective of the present invention is to provide an improved underwire bra particularly having two bra cups directly deposed on the lining, and the elastic cloth having the same contour and configuration as the bra covers the lining and the bra cups, and a whole-piece single-edge sewing is performed at the edge of the top section of the bra. Such bra structure is a whole-piece with which the wire is not exposed. In addition to its naturally showing the beauty of brassiere, it also can save the manufacturing cost and increase the production rate and the comfort of wearing, and particularly it features an economic way of production and has the effect of perfect fit without binding.

Another objective of the present invention is to provide an underwire bra that completely has no seam because the bra cups and the front piece are extended directly to a back piece and needs no coupling. It gives a very comfortable feeling when wearing, and a perfect fit for the curve provides an artistic look.

Another objective of the present invention is to restrict and prevent the turning over of the obverse cloth by having a strongly elastic segment of appropriate width extended at the lower edge of the obverse cloth, and it also reliably binds but creates no stress for reinforcing the positioning.

Another further objective of the present invention is to provide an underwire bra that can fully lift and support a woman's breast and prevent any outward expansion or downcast by using non-elastic steel plates as the isolating filling between the bra cups in order to ensure the constant distance between bra cups.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

FIG. I shows the diagram of the lining formation at the backside of a conventional bra structure

DESCRIPTION OF THE PREFERRED EMBODIMENT

Figure 1:
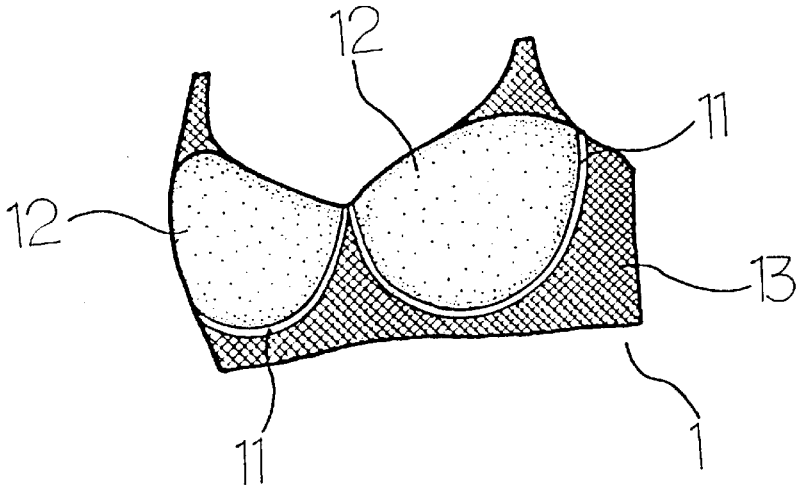
FIG.1 PRIOR ART
Figure 2:
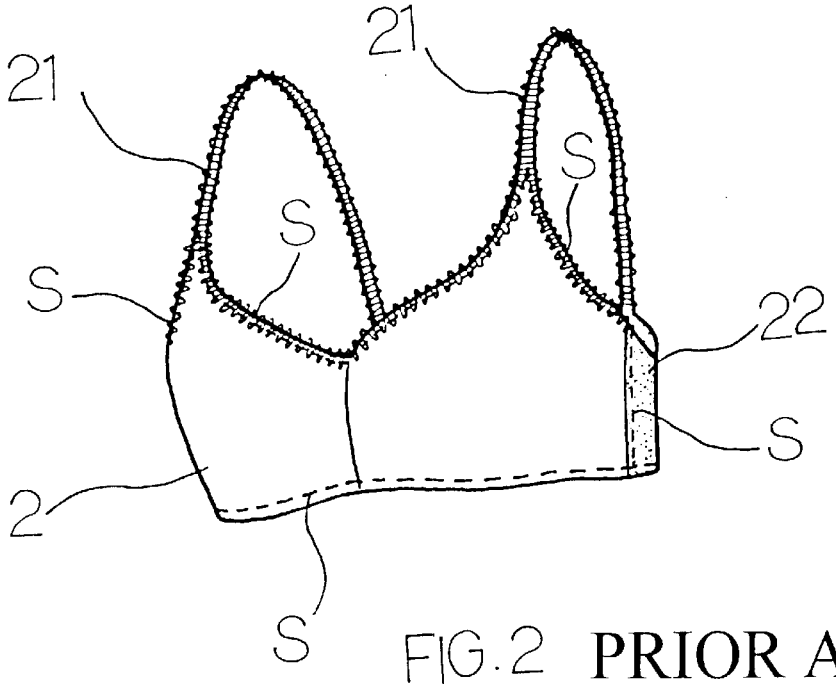
FIG.2 PRIOR ART
FIG. 2 shows the diagram of an assembled: conventional bra
Figure 3:
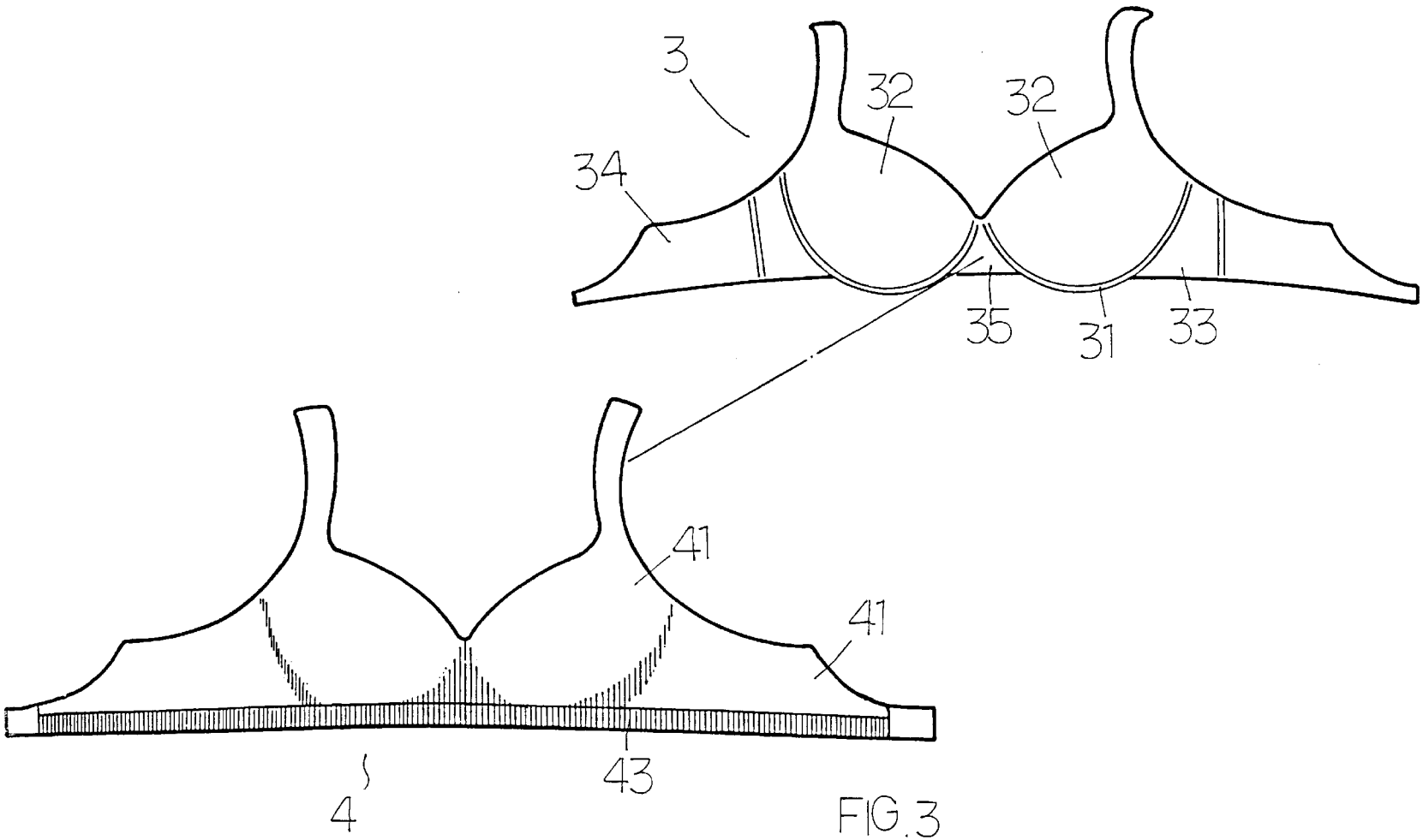
FIG. 3 shows the three-dimensional diagram of the disassembled parts of the structure according to the present invention (The lining at the back and the obverse cloth in the front of the bra).
Figure 4:
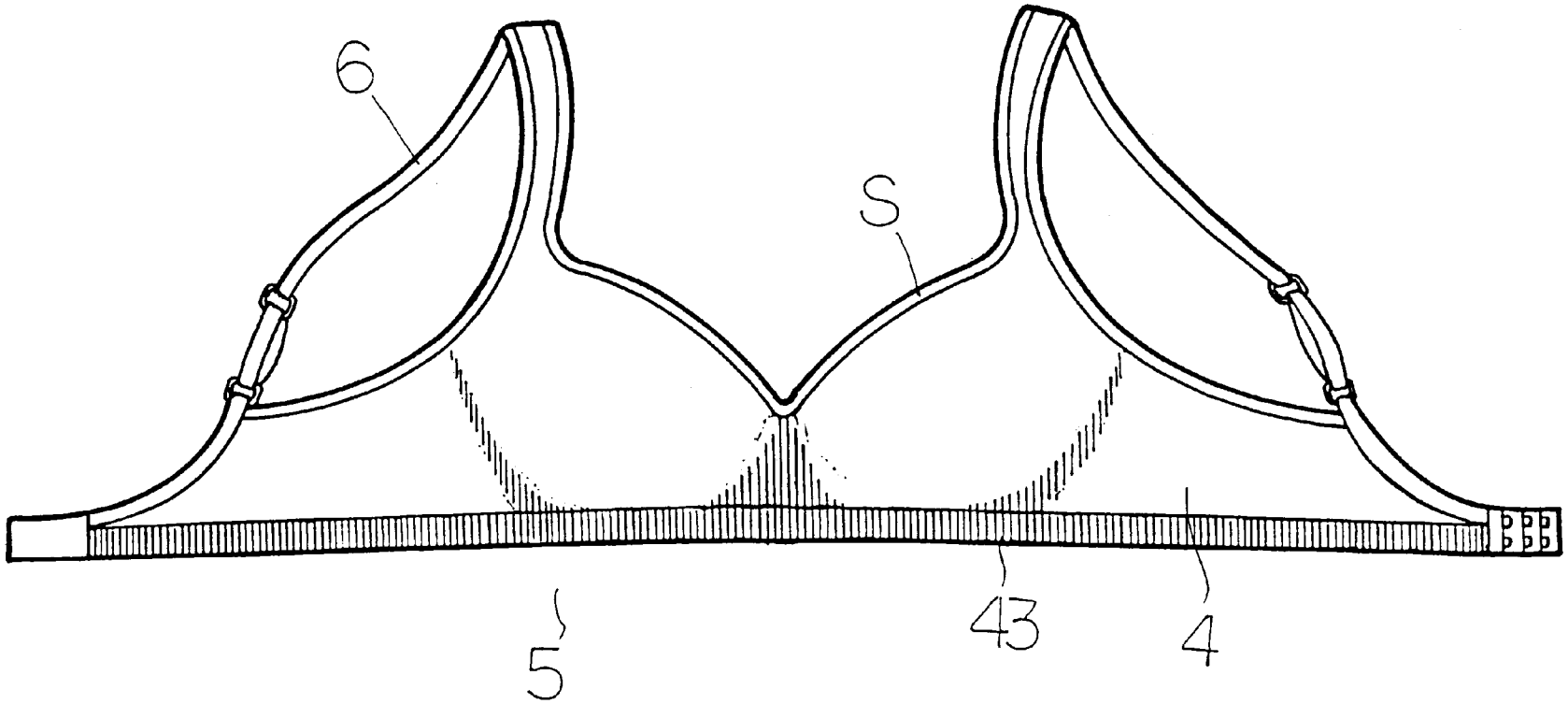
FIG. 4 shows the front-view diagram of the backside and the front seam of the bra are sewed according to the present invention.

Please refer to FIGS. 3 and 4. The underwire bra of the present invention mainly comprises a bra cup 32 having a wire 31 attached to it, and together with a piece of properly cut elastic cloth to couple with a lining 3 at the backside of the bra, and both lateral sides are extended to a back piece 34 as a whole piece. A non-elastic net piece 35 is deposed between the bra cups, and a piece of obverse cloth 4 having the same contour and configuration as the bra, and that is the curved cloth formed (see FIG. 3) completely covers the whole lining 3 and the bra cups 32. By the single-edge sewing S at the upper section of the bra, the lining 3 and the obverse cloth 4 are extended to couple with a back piece 51 to form a whole-piece bra 5. Such bra 5 can be used directly or goes with a movable shoulder strap 6. The bra cup 32 can completely hold a woman's breast, and the whole bra 5 has a seamless look due to the invisible wire 31, but still retains the reliability of focusing to lift a woman's breast and simplifies the production, lowers cost and enhances production efficiency.

Figure 5:
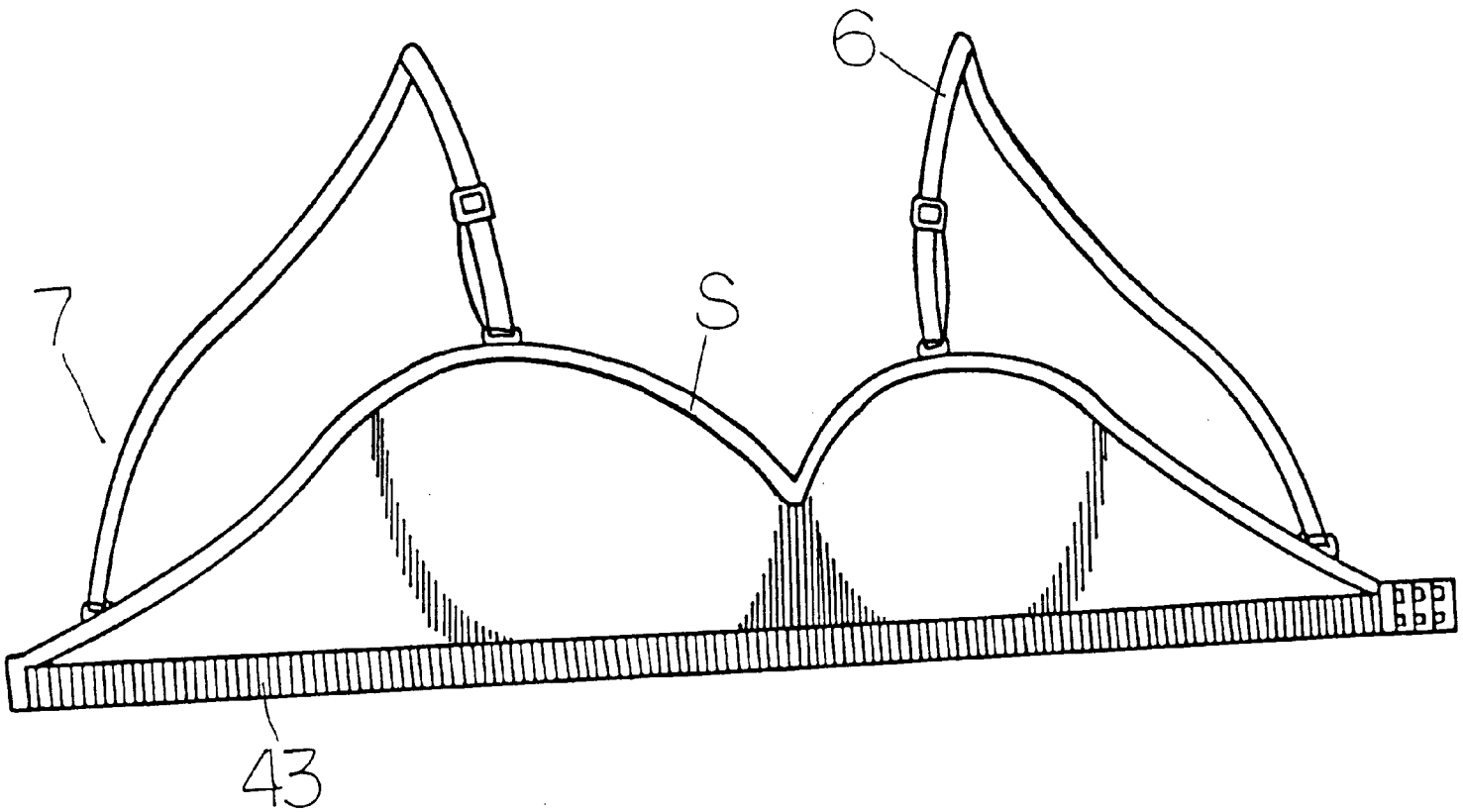
FIG. 5 shows the diagram of the assembled bra of another embodiment of the present invention.
Figure 6:
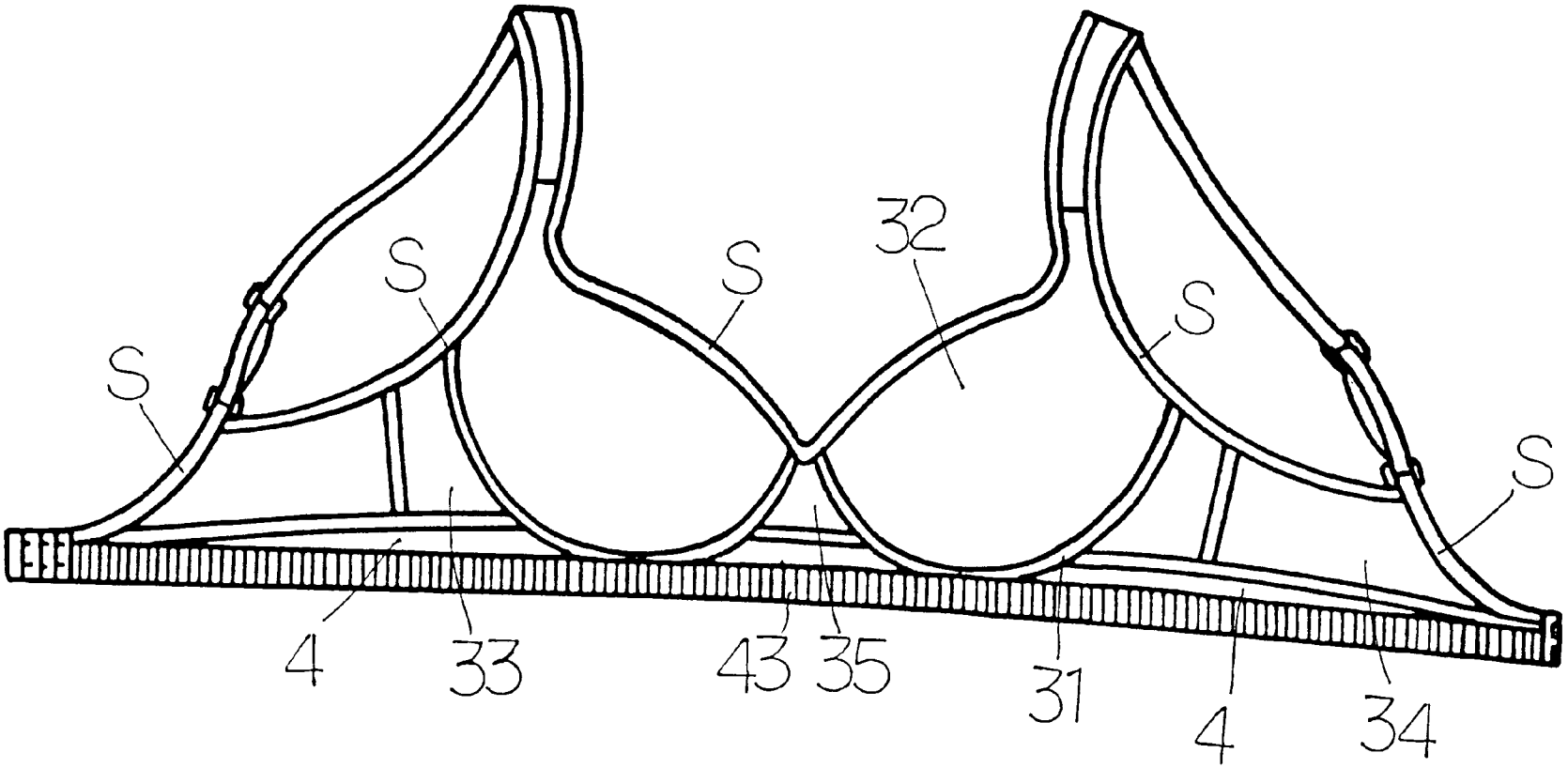
FIG. 6 shows the rear-view diagram of the backside and the front seam of the bra are sewed according to the present invention.
Figure 7:
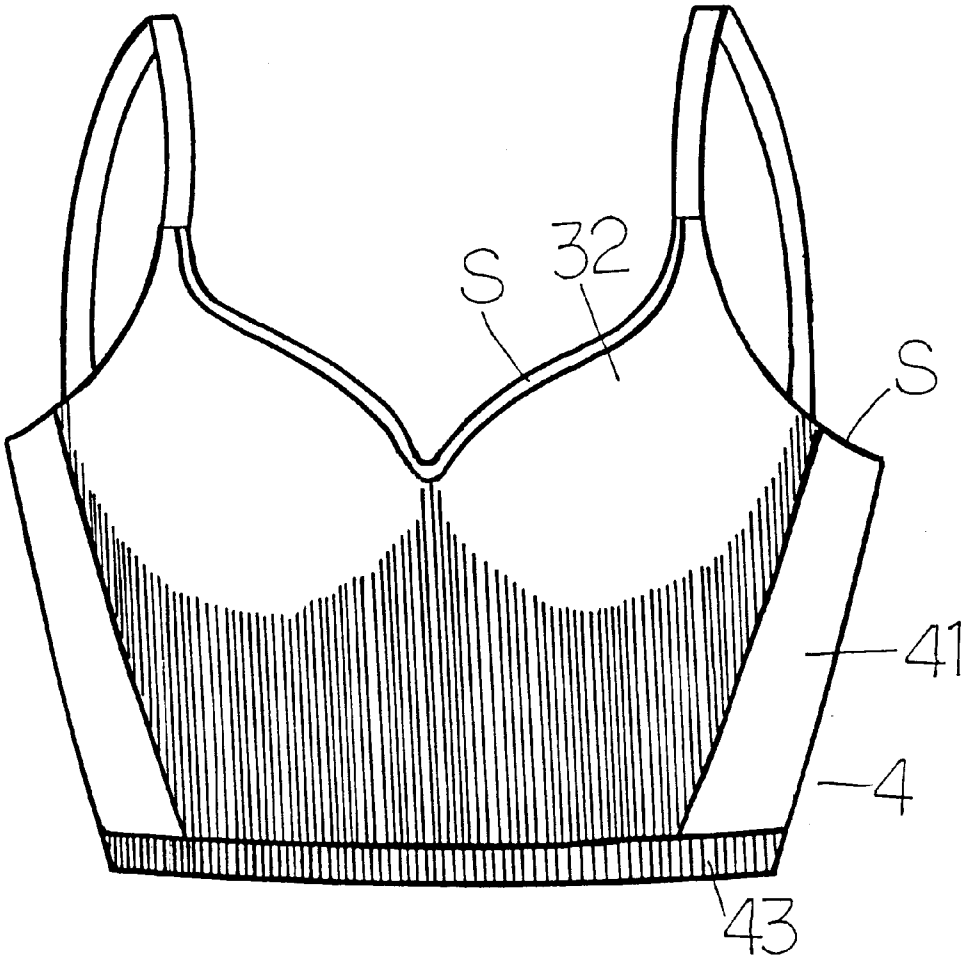
FIG. 7 shows the front-view diagram of a long bra according to another embodiment of the present invention.
Figure 8:
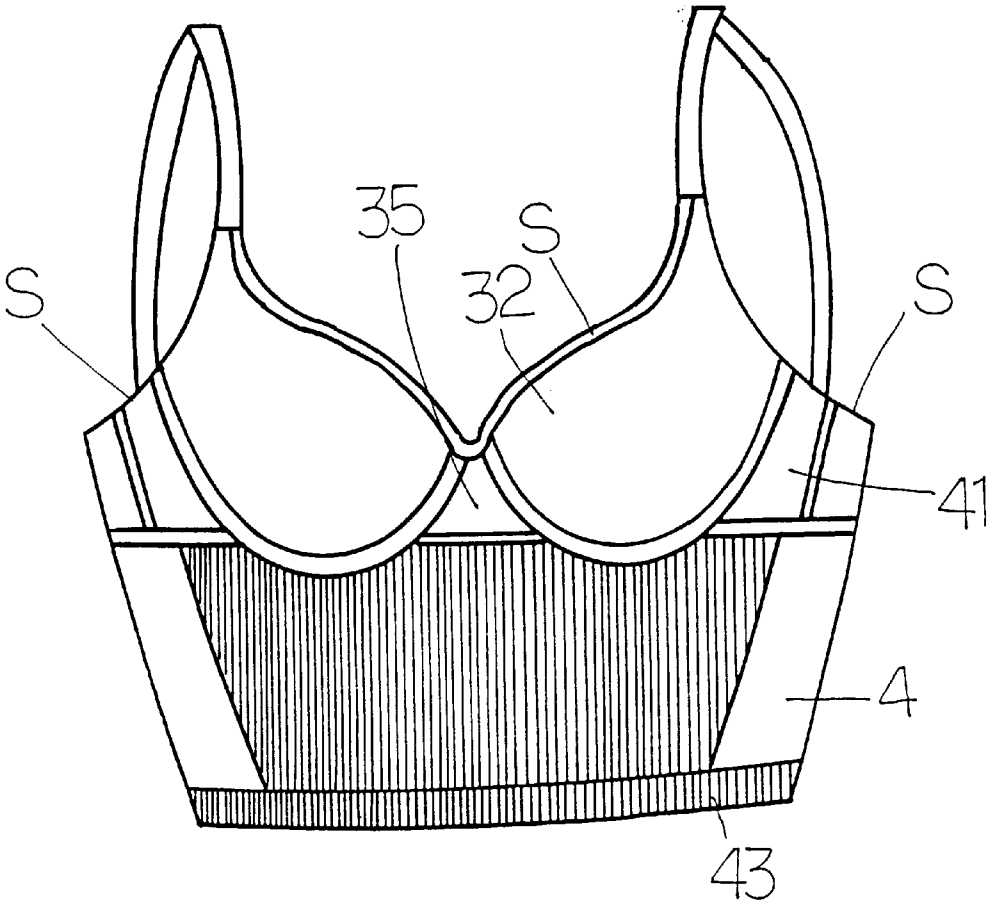
FIG. 8 shows the diagram of the interior of a long bra according to another embodiment of the present invention.

Furthermore, please refer to FIG. 5. A strongly elastic segment 43 of appropriate width that is larger than the lining 3 is extended and deposed at the lower edge of the obverse cloth 4. Besides, using the strongly elastic segment for the covering, it restricts and prevents the turning over of the obverse cloth 4 and give a reliable binding to the whole bra 7 but does not have any stress for the reinforcement of the positioning. Further, when the user wears the bra, it gives the user a comfortable feeling and when casual wear is needed, the wire in the bra cups can be removed.

Therefore, in summation of the above description, the improved underwire bra of the present invention obviously simplifies its formation compared with the traditional underwire bras, and beautifies the curve of a woman's bust, and gives a perfect fit to it, and the comfort when wearing. The inventor of the present invention based on years of experience in the related industry conducted extensive research to enhance the structure of the storage rack herein which is hereby submitted for patent application.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An improved bra, comprising:

a plurality of underwire bra cups;

a lining having a cut elastic cloth sewed on a back side of the bra;

an obverse elastic cloth having a contour and configuration of the bra and completely covering the lining and the underwire bra cups; and a back piece extending from the lining and the obverse cloth to form said bra, such that the bra fully adopts a woman's bust and provides a seamless look.

2. The improved bra as claimed in claim 1, wherein a lower edge of the obverse cloth has a whole-piece elastic segment, which is larger than the lining.

3. The improved bra as claimed in claim 1, wherein the lining includes a non-elastic net piece as an isolating filling between the bra cups to keep a constant distance between the bra cups.

4. The improved bra as claimed in claim 1, wherein the obverse elastic cloth is an elastic knitted cloth.

5. The improved bra as claimed in claim 1, wherein a wire in the bra cups is removable.

* * * * *